US009814337B2

(12) United States Patent
Loewenberg

(10) Patent No.: US 9,814,337 B2
(45) Date of Patent: Nov. 14, 2017

(54) BAG HOLDING DEVICE

(71) Applicant: Michael Bert James Loewenberg, Apollo Beach, FL (US)

(72) Inventor: Michael Bert James Loewenberg, Apollo Beach, FL (US)

(73) Assignee: Michael Bert James Loewenberg, Apollo Beach, FL (US)

( * ) Notice: Subject to any disclaimer, the term of this patent is extended or adjusted under 35 U.S.C. 154(b) by 49 days.

(21) Appl. No.: 14/997,374

(22) Filed: Jan. 15, 2016

(65) Prior Publication Data

US 2016/0207666 A1 Jul. 21, 2016

Related U.S. Application Data

(60) Provisional application No. 62/104,011, filed on Jan. 15, 2015.

(51) Int. Cl.
*B65D 33/00* (2006.01)
*A47G 19/30* (2006.01)

(52) U.S. Cl.
CPC ..... *A47G 19/30* (2013.01); *B65D 33/00* (2013.01)

(58) Field of Classification Search
CPC ..... A47G 19/30; B65D 33/00
USPC ..... 248/95, 97
See application file for complete search history.

(56) References Cited

U.S. PATENT DOCUMENTS 2,470,271 A * 5/1949 Steinbacher ..... B65B 67/1244 220/264
3,514,061 A * 5/1970 Doyen ..... A47G 23/0258 248/346.5
5,007,606 A * 4/1991 Allen ..... A45F 3/00 211/85
5,797,567 A * 8/1998 Magnafici ..... B65B 67/1227 248/101
7,124,990 B1 * 10/2006 Sanathra ..... A47G 19/30 206/737
8,292,239 B1 * 10/2012 Elden Limb ..... B65B 67/1205 248/163.2
9,033,291 B2 * 5/2015 Branham ..... B65B 67/1211 248/100
9,592,931 B2 * 3/2017 Woodruff ..... B65D 25/06
2005/0133674 A1 * 6/2005 Sobue ..... A61J 1/16 248/95
2010/0314507 A1 * 12/2010 Laitila ..... B65B 67/1227 248/97

* cited by examiner

*Primary Examiner* — Bradley Duckworth
(74) *Attorney, Agent, or Firm* — Kali Law Group, P.C.

(57) ABSTRACT

Bag holding devices are presented including: a base having an inclined housing portion and a raised planar portion; a spring-loaded clamping element disposed along the raised planar portion and pivotally coupled with the planar portion; and a retractable reel disposed within the inclined housing portion. In some embodiments, devices further include: a mating groove disposed along an outer edge of the inclined housing portion; and a bowl having a mating portion that mates with the mating groove. In some embodiments, devices further include: a mating groove disposed along an outer edge of the inclined housing portion; and an accessory having a mating portion that mates with the mating groove, where in the accessory is any of: a novelty item, a promotional item, and a message plaque.

18 Claims, 8 Drawing Sheets

BAG HOLDING DEVICE

BACKGROUND

One of the most common types of closures for bags holding consumable products is the common chip clip. Chip clips and other conventional bag closing devices apply a clamping force to a folded end of a bag. In many cases chip clips do not clamp the entire top end of the bag, which may allow air into the bag. Often, the product in the bag becomes quickly spoiled or stale because of such leakage. In some examples, a chip clip may clamp the entire folded end of the bag. However, the clamping force is often inadequate because the force to properly seal the bag with the chip clip having such a large surface would be so large as to make the device unusable.

Chip clips and other bag closing devices generally attach to the top of a bag and are only attached when the bag is in the closed position. To open the closed bag the consumer must remove and set aside the clip or other closing device which may be easily misplaced causing many to waste time looking for misplaced clips or other bag closing devices. In addition, conventional chip clips don't last very long and many lose strength over time which ends up costing the consumer frustration and money in replacing these weak clips.

As such bag holding devices are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such bag holding devices are presented including: a base having an inclined housing portion and a raised planar portion; a spring-loaded clamping element disposed along the raised planar portion and pivotally coupled with the planar portion; and a retractable reel disposed within the inclined housing portion. In some embodiments, devices further include: a mating groove disposed along an outer edge of the inclined housing portion; and a bowl having a mating portion that mates with the mating groove. In some embodiments, devices further include: a mating groove disposed along an outer edge of the inclined housing portion; and an accessory having a mating portion that mates with the mating groove, where in the accessory is any of: a novelty item, a promotional item, and a message plaque. In some embodiments, the spring-loaded clamping element includes: a number of notched teeth disposed along a proximal edge of the spring-loaded clamping element, where the number of notched teeth are located to exert clamping force along a boundary line between the inclined housing portion and the raised planar portion; a torsion spring disposed along a pivot axis for providing a clamping force; and a catch disposed along a distal edge of the spring-loaded clamping element for releasably securing a retractable line. In some embodiments, the catch is a structure such as: a hook, a ring, a slot, and a tab. In some embodiments, the torsion spring has a torque in a range of approximately 4.25 to 5.50 inch-pounds at 90 degrees. In some embodiments, devices further include: the notched teeth have a width in a range of approximately 0.10 to 0.20 inches. In some embodiments, devices further include: an indent disposed along a top surface of the spring-loaded clamping element for providing tactile feedback to a user. In some embodiments, the retractable reel includes: a length of retractable line retractably secured with the retractable reel; and a stopper disposed along an end of the length of retractable line. In some embodiments, the stopper is any of: a ring, a ball, a rubber stopper, a cork stopper, a loop, and a hook.

In other embodiments, bag holding devices are presented including: a base having an inclined housing portion and a raised planar portion; a spring-loaded clamping element disposed along the raised planar portion and pivotally coupled with the planar portion; a retractable reel disposed within the inclined housing portion; a mating groove disposed along an outer edge of the inclined housing portion; and a bowl having a mating portion that mates with the mating groove. In some embodiments, the spring-loaded clamping element includes: a number of notched teeth disposed along a proximal edge of the spring-loaded clamping element, where the number of notched teeth are located to exert clamping force along a boundary line between the inclined housing portion and the raised planar portion; a torsion spring disposed along a pivot axis for providing a clamping force; and a catch disposed along a distal edge of the spring-loaded clamping element for releasably securing a retractable line.

In other embodiments, methods for securing a bagged product using a bag holding device are presented including: providing the bagged product; placing the bagged product upright on the bag holding device, the bag holding device including, a base having an inclined housing portion and a raised planar portion, a spring-loaded clamping element disposed along the raised planar portion and pivotally coupled with the planar portion, and a retractable reel disposed within the inclined housing portion, where the spring-loaded clamping element includes, a number of notched teeth disposed along a proximal edge of the spring-loaded clamping element, where the number of notched teeth are located to exert clamping force along a boundary line between the inclined housing portion and the raised planar portion, a torsion spring disposed along a pivot axis for providing a clamping force, and a catch disposed along a distal edge of the spring-loaded clamping element for releasably securing a retractable line; and clamping a bottom edge of the bagged product with the spring-loaded clamping element. In some embodiments, methods further include: folding a top portion of the bagged product; extending the retractable line over the bagged product; and securing the retractable line with the catch.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
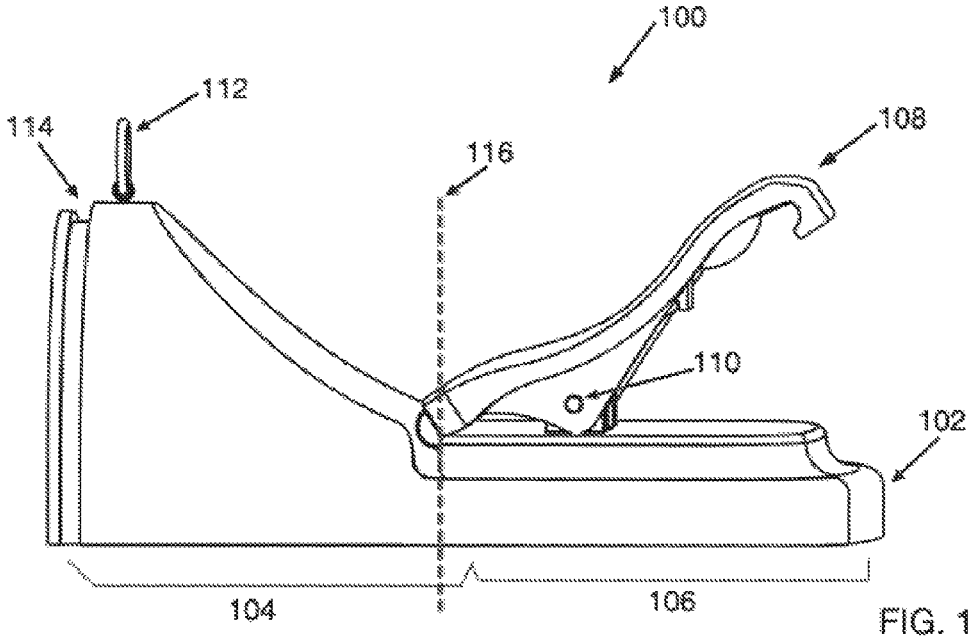
FIG. 1 is an illustrative side view representation of a bag holding device in accordance with embodiments of the present invention.

FIG. 1 is an illustrative side view representation of a bag holding device 100 in accordance with embodiments of the present invention. In particular, base 102 is illustrated having an inclined housing portion 104 and a raised planar portion 106. As may be appreciated, embodiments provided herein may be manufactured from a variety of materials such as polymeric materials, metals, metal compositions, and natural materials. In addition, embodiments may be manufactured utilizing any process known in the art such as injection molding, machining, forming, welding, 3D printing and the like without departing from embodiments herein. Further illustrated is spring-loaded clamping element 108 disposed along raised planar portion 106. As may be seen, spring-loaded clamping element 108 may be pivotally coupled at pivot 110 with raised planar portion 106. Spring-loaded clamping element embodiments will be discussed in further detail below for FIG. 4.

Figure 2:
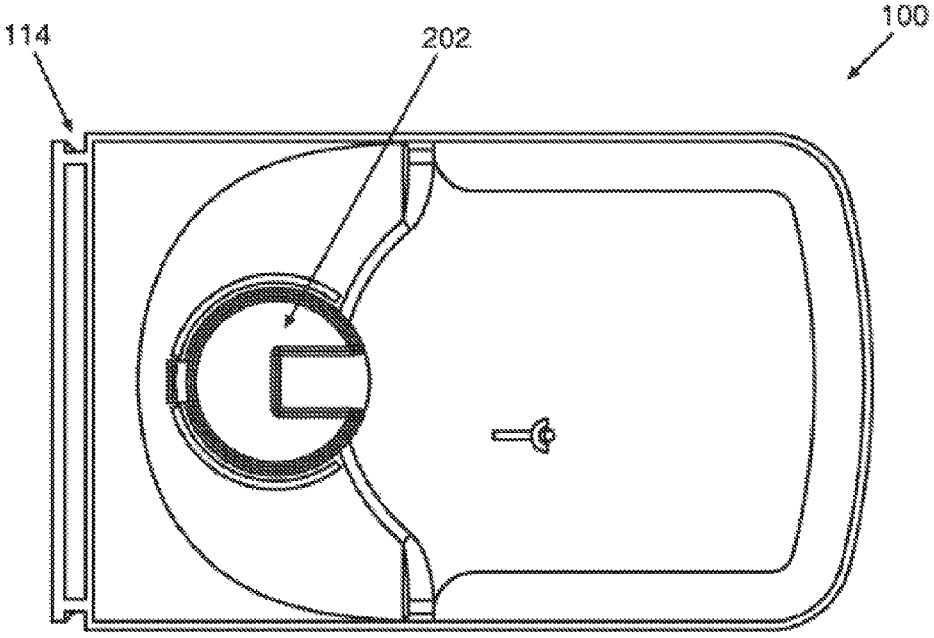
FIG. 2 is an illustrative bottom view representation of a bag holding device in accordance with embodiments of the present invention.

Turning briefly to FIG. 2, which is an illustrative bottom view representation of bag holding device 100 in accordance with embodiments of the present invention. In embodiments, inclined housing portion 104 may include retractable reel 202 which may be housed therein. Returning to FIG. 1, retractable wheel may further include a length of retractable line retractably secured with the retractable reel and stopper 112 disposed along an end of the length of retractable line. In embodiments, inclined housing portion may include a line channel to provide smooth extension and retraction of retractable lines. In embodiments, stoppers may include a ring, a ball, a rubber stopper, a cork stopper, a loop, and a hook without limitation. In other embodiments, lines may include, a natural fiber line, a polymeric fiber line, a metal fiber line, and any combination of natural, polymeric, or metal fiber. Importantly, line materials may be selected for repeated use. As such, rigid lines may not be suitable for embodiments provided herein. Further illustrated is mating groove 114, disposed along an outer edge of inclined housing portion 104. Mating groove embodiments will be discussed in further detail below for FIG. 5.

Figure 3:
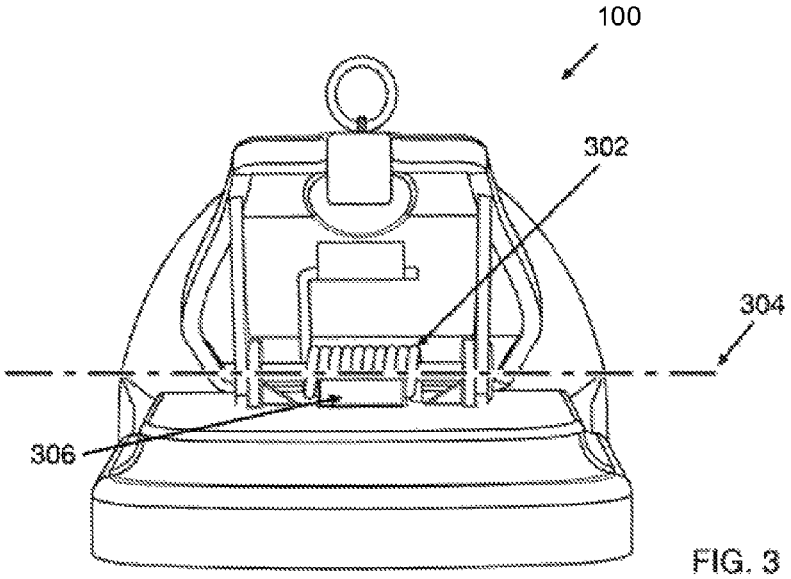
FIG. 3 is an illustrative rear view representation of a bag holding device in accordance with embodiments of the present invention.

FIG. 3 is an illustrative rear view representation of bag holding device 100 in accordance with embodiments of the present invention. In particular, torsion spring 302 may be disposed along pivot axis 304 for providing a clamping force for bags being held by embodiments provided herein. A torsion spring providing a torque in a range of approximately 4.25 to 5.50 inch-pounds at 90 degrees may be utilized in embodiments. This level of torque may provide sufficient clamping force to securely hold a bagged product without being unduly difficult for a consumer to operate the spring-loaded clamping element. In embodiments, spring support 306 may be utilized to support the torsion spring. Spring support embodiments may include a curved upper surface to accommodate the torsion spring. A spring support may be desirable to prevent spring binding and ensure a consistent clamping force.

Figure 4A:
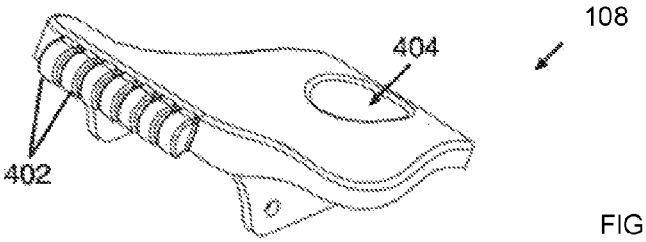
FIGS. 4A-4C are illustrative representations of a spring-loaded clamping element in accordance with embodiments of the present invention.
Figure 4B:
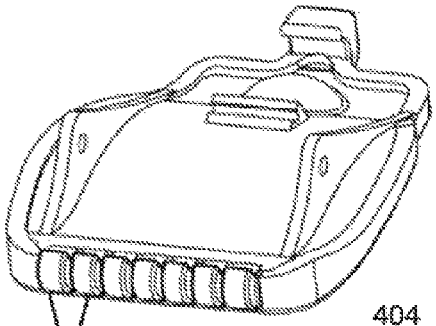
Figure 4C:
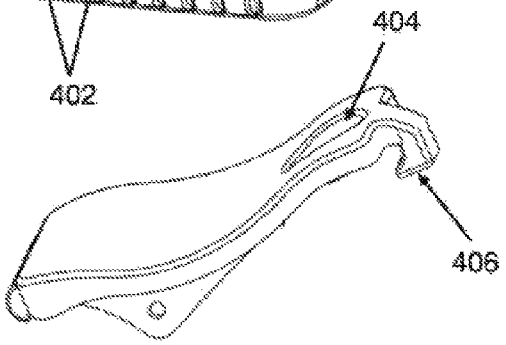

FIG. 4A is an illustrative representation of spring-loaded clamping element 108 in accordance with embodiments of the present invention. In particular, several views are presented of clamping element 108 in order to more clearly illustrate embodiments provided herein. As illustrated, spring-loaded clamping element 108 may include a number of notched teeth 402 disposed along a proximal edge of spring-loaded clamping element 108. Referring briefly to FIG. 1, it may be seen that the notched teeth are located to exert clamping force along boundary line 116 between inclined housing portion 104 and raised planar portion 106. In embodiments, the notched teeth may have a width in a range of approximately 0.10 to 0.20 inches. It may be appreciated that the width of teeth may be selected to provide optimum clamping to a particular bag composition. By clamping along an edge of raised planar portion 106, clamping forces may be focused to provide a more secure hold. Returning to FIG. 4B, further illustrated is indent 404 disposed along a top surface of spring-loaded clamping element 108 for providing tactile feedback to a user. In embodiments, indent 404 may increase the contact friction for a user's finger to avoid slippage and provide a more positive contact. Further illustrated in FIG. 4C is catch 406 disposed along a distal edge of spring-loaded clamping element 108 for releasably securing a retractable line. Referring briefly to FIG. 1 spring-loaded clamping element 108 is configured as a hook having a curvature selected to prevent accidental disengagement of stopper 112 (configured as a ring) that is coupled with the retractable line. Although a hook structure for securing the retractable line is illustrated, other embodiments may include a ring structure, a slot structure and a tab structure matched to an appropriate stopper as described above. In these arrangements, the stopper/catch configuration may be designed to prevent accidental disengagement of the stopper.

Figure 5:
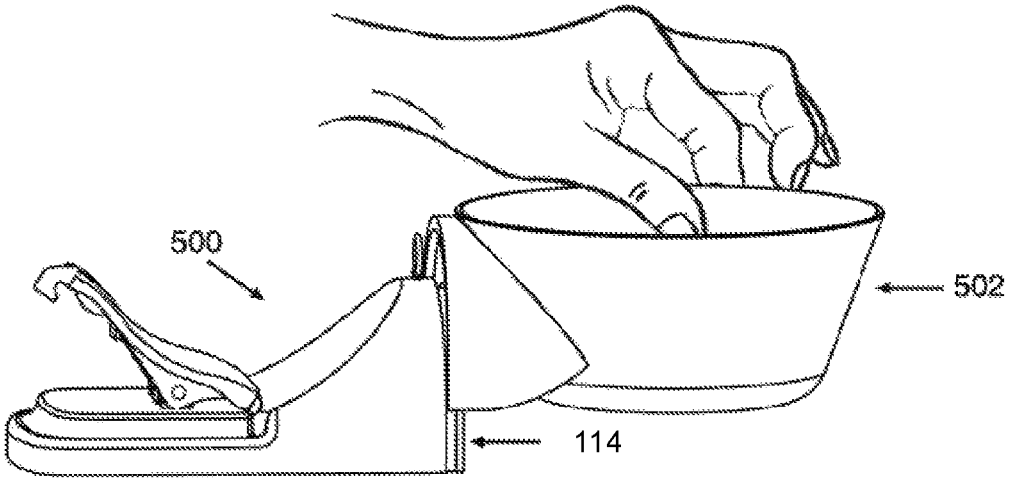
FIG. 5 is an illustrative representation of a bag holding device and bowl in accordance with embodiments of the present invention.
Figure 5:
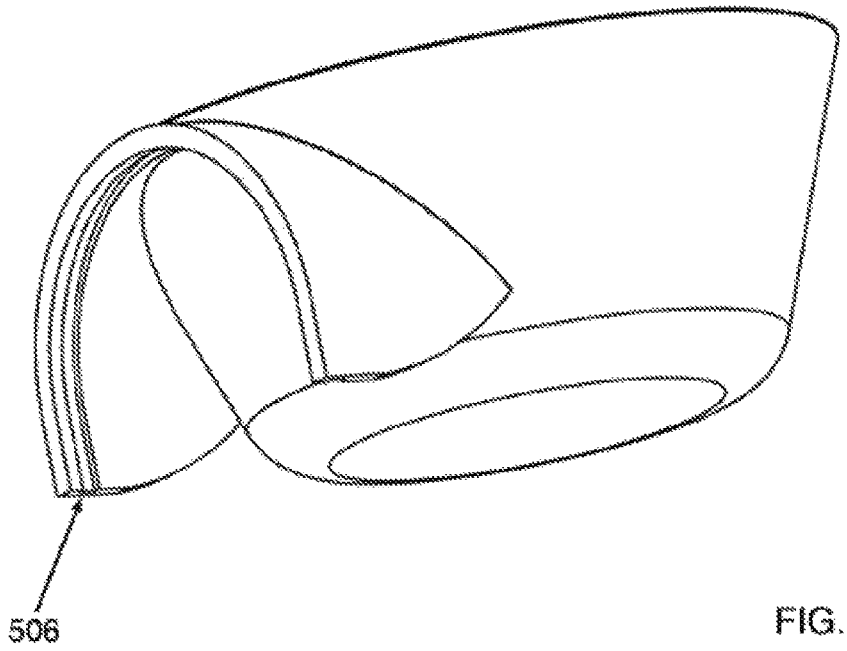

FIG. 5 is an illustrative representation of bag holding device 500 and bowl 502 in accordance with embodiments of the present invention. As noted above, mating groove 114 may be disposed along an outer edge of the inclined housing portion. Similarly, bowl 502 may include bowl mating portion 506 that mates with mating groove 114. In this manner, an accessory bowl may be easily engaged and removed from bag holding device embodiments. For example, when bag holding device embodiments are utilized to hold a bag of chips, bowls of salsa may be coupled with the bag holding device so that salsa and chips remain in close proximity. It may be appreciated that any number of accessories of different sizes and shapes may be utilized that have a mating groove such as that illustrated herein. In embodiments, accessories may include, novelty items, promotional items, and message boards of plaques without limitation. An example accessory embodiment is discussed in further detail below for FIG. 10.

Methods of Use

Figure 6:
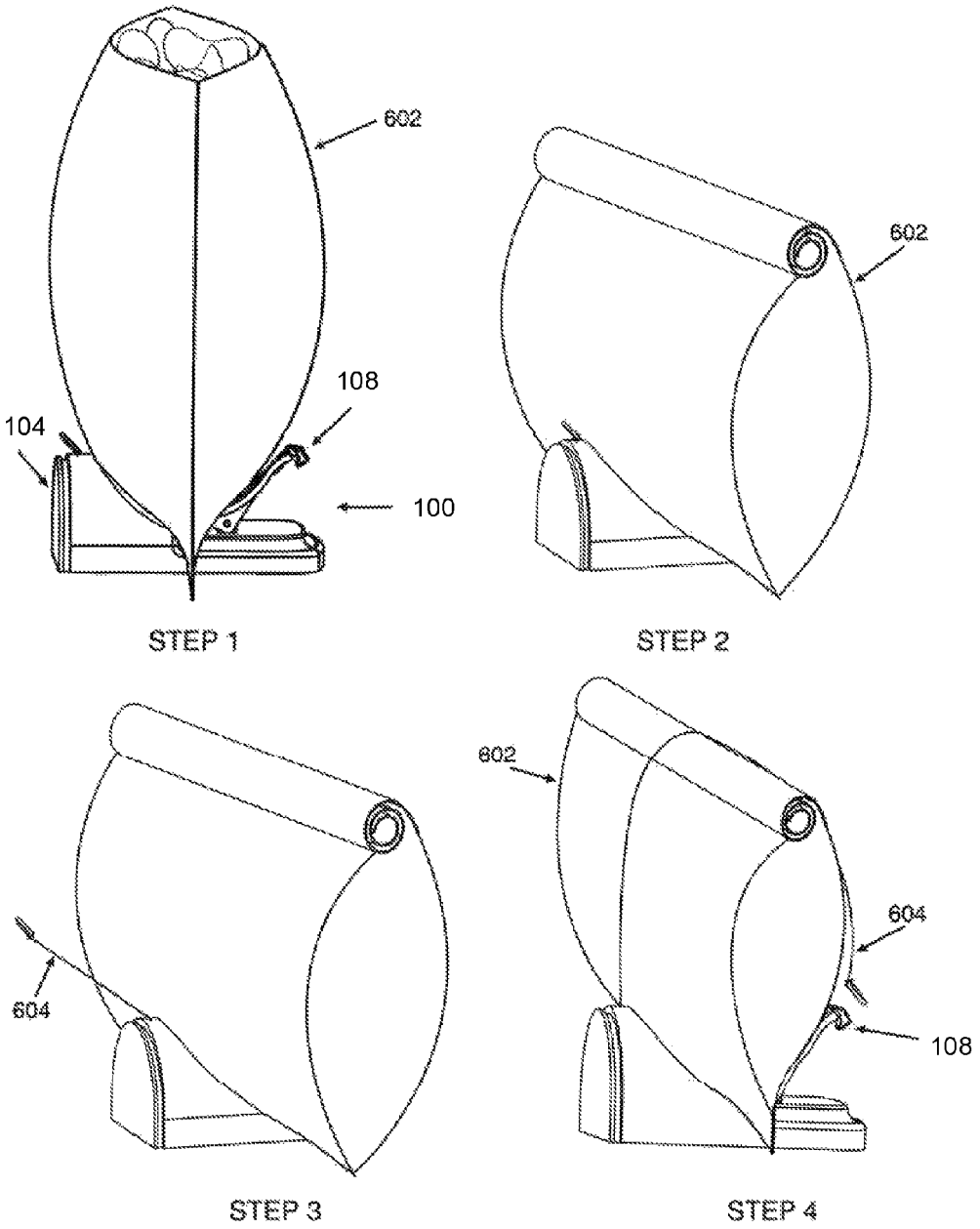
FIG. 6 is an illustrative representation of a bag holding device in use in accordance with embodiments of the present invention.

FIG. 6 is an illustrative representation of bag holding device 100 in use in accordance with embodiments of the present invention. As illustrated at a STEP 1, bagged product 602 may be opened and placed upright on bag holding device 100. Bagged products may include any number of products without limitation and is not restricted to edible products in embodiments. As may be seen, the bottom edge of bagged product 602 may be secured by spring-loaded clamping element 108. As may be further seen, bagged product 602 may be supported upright by inclined housing portion 104 and spring-loaded clamping element 108. In this position, bagged products may be easily accessed with reduced concern for spilling or tipping. At a STEP 2, bagged product 602 is closed by folding or rolling the top portion of the bag. At a STEP 3, retractable line 604 may be extended. At a STEP 4, retractable line 604 may be extended over bagged product 602 and secured with catch 108. In this position, bagged products may be stored and adequately sealed against premature spoiling. Furthermore, because bagged products are maintained upright, storage may be more efficient and easily accessed. In embodiments, opening the bagged product is the reverse of the methods disclosed above. That is, the retractable line may be unsecured from the catch; the retractable line may be retracted; and the top portion of the bagged product may be unfolded. In some embodiments, an attachable bowl or accessory may be attached with the bag holding device.

Alternate Embodiments

Figure 7:
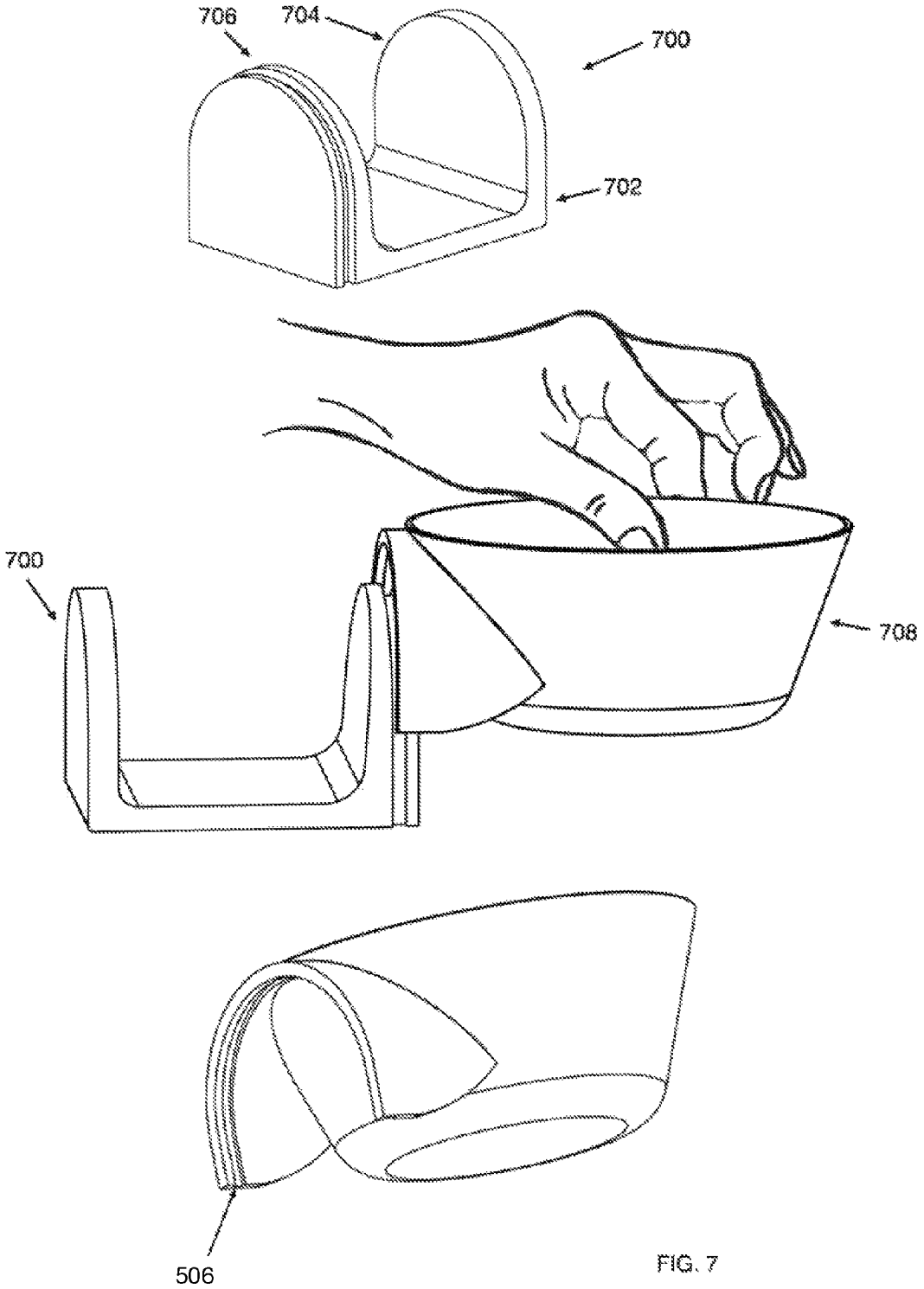
FIG. 7 is an illustrative representation of an alternate bag holding device and bowl in accordance with embodiments of the present invention.

FIG. 7 is an illustrative representation of an alternate bag holding device 700 and bowl 708 in accordance with embodiments of the present invention. As illustrated, bag holding device 700 includes a planar base 702 and two upright planar surfaces 704 and 706 each disposed along opposite edges of planar base 702. Upright planar surface 706 further includes a mating groove configured to receive mating portion 506 corresponding with bowl 708. As above, any number of accessories of different sizes and shapes may be utilized that have a mating portion such as that illustrated herein. In embodiments, accessories may include, novelty items, promotional items, and message boards of plaques without limitation. An example accessory embodiment is discussed in further detail below for FIG. 10. The illustrated embodiment presents a simplified bag holding device that does not provide sealing features or clamping features.

Figure 8:
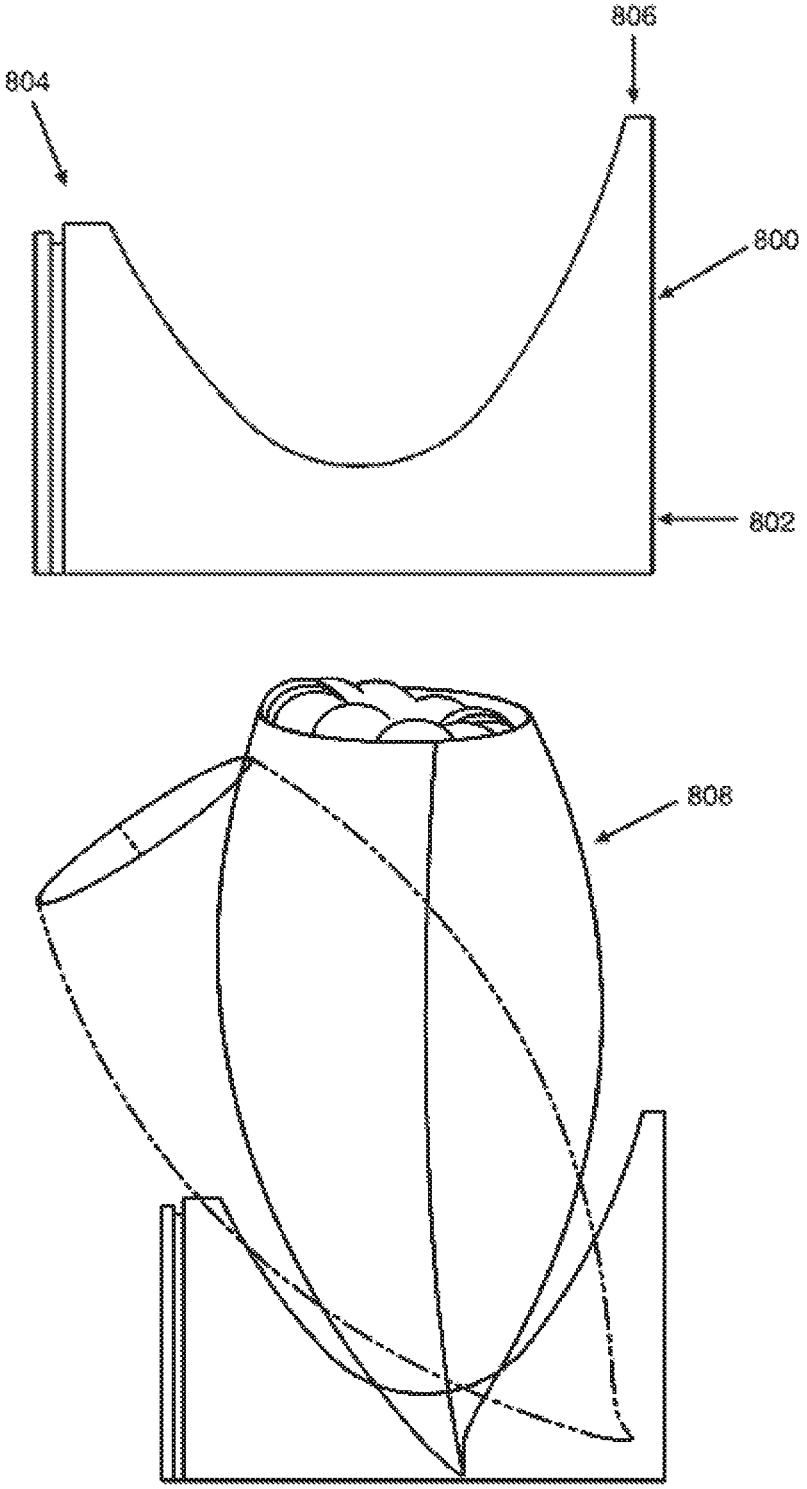
FIG. 8 is an illustrative representation of an alternate bag holding device in use in accordance with embodiments of the present invention.

FIG. 8 is an illustrative representation of an alternate bag holding device 800 in use in accordance with embodiments of the present invention. As illustrated, bag holding device 800 includes a curved surface base 802 and two upright planar surfaces 804 and 806 each disposed along opposite edges of curved surface base 802. Upright planar surface 806 further includes a mating groove configured to receive a mating portion as discussed in other embodiments provided herein and corresponding with a bowl or accessory. As above, any number of accessories of different sizes and shapes may be utilized that have a mating portion such as that illustrated herein. In embodiments, accessories may include, novelty items, promotional items, and message boards of plaques without limitation. An example accessory embodiment is discussed in further detail below for FIG. 10. It may be appreciated that the use of a curved surface provides different angles by which bagged product 808 may be presented for access.

Figure 9:
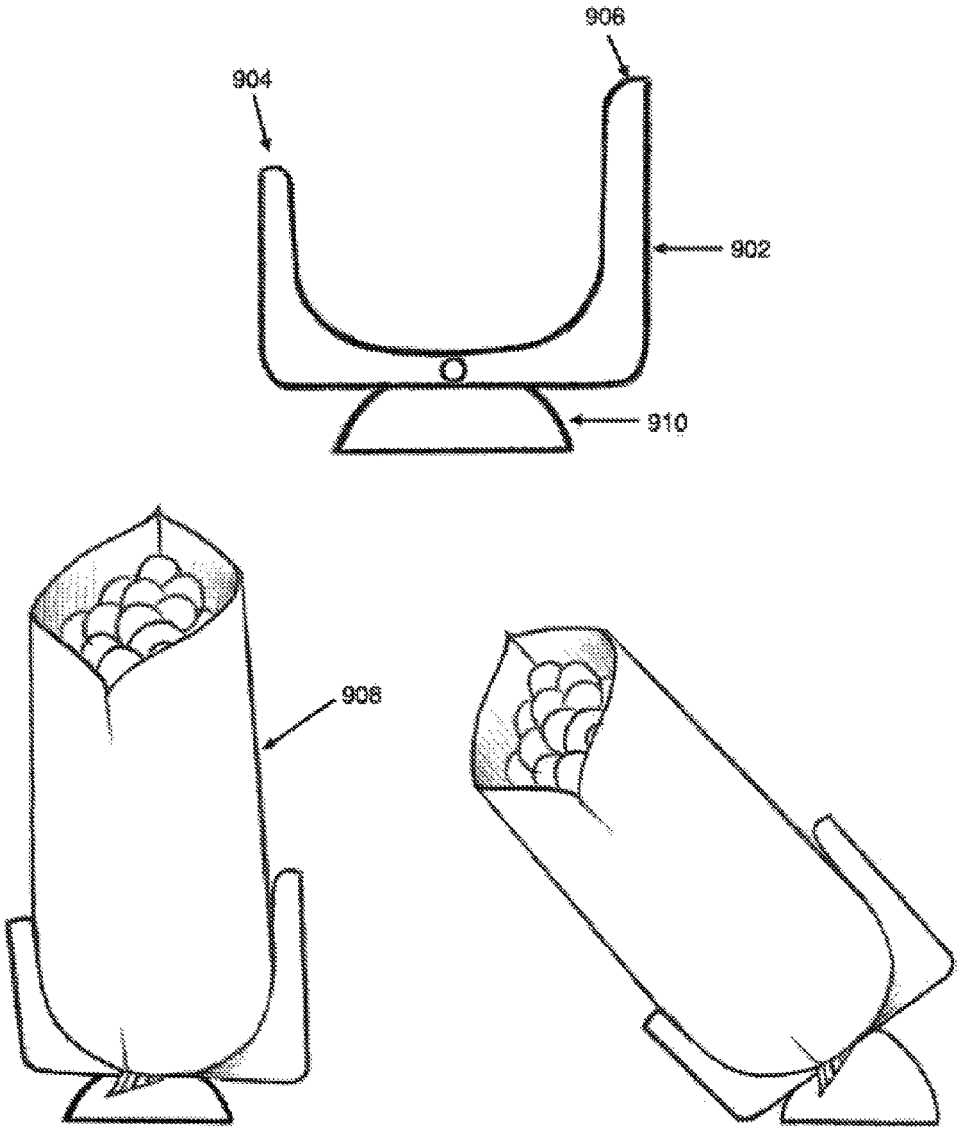
FIG. 9 is an illustrative representation of an alternate bag holding device in use in accordance with embodiments of the present invention.

FIG. 9 is an illustrative representation of an alternate bag holding device 900 in use in accordance with embodiments of the present invention. As illustrated, bag holding device 900 includes a planar surface base 902 and two upright planar surfaces 904 and 906 each disposed along opposite edges of planar surface 902. Bag holding device 900 may further include pivoting element 910. It may be appreciated that the use of a pivoting feature may provide different angles by which bagged product 908 may be presented for access.

Figure 10:
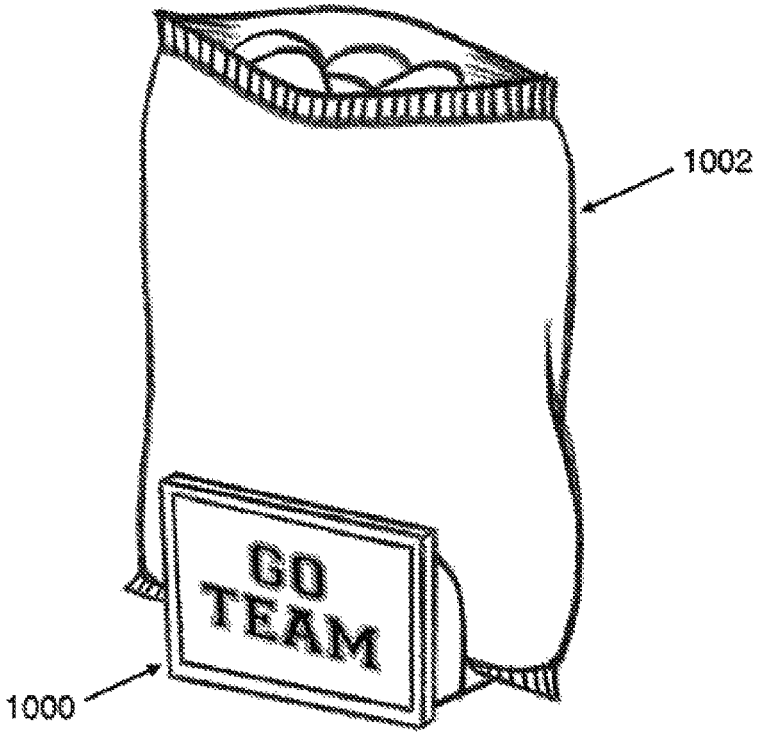
FIG. 10 is an illustrative representation of an accessory for bag holding devices in use in accordance with embodiments of the present invention.
Figure 10:
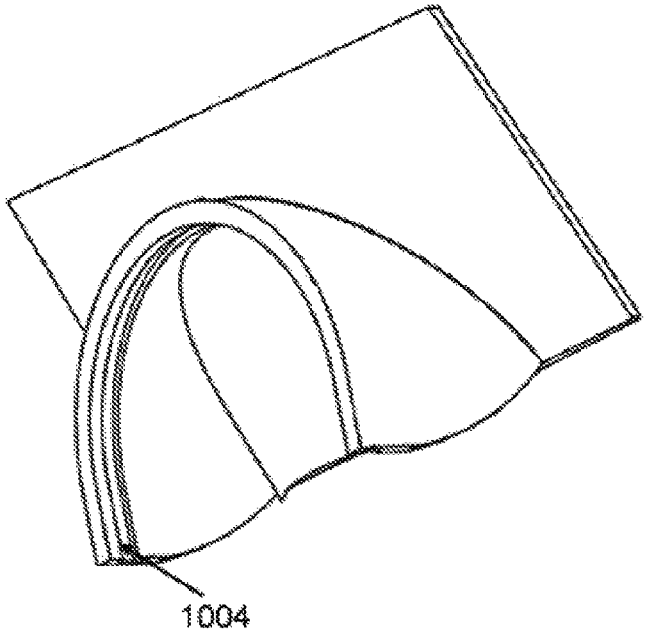

FIG. 10 is an illustrative representation of an accessory 1000 for bag holding devices in use in accordance with embodiments of the present invention. In particular, FIG. 10 is an illustrative representation of a message board embodiments. As may be seen, a message may be displayed on accessory 1000. The message, in embodiments, may be pre-printed directly on the accessory, provided in a label, or simply applied or written directly by a consumer. In some embodiments, a message on accessory 1000 may correspond with bagged product 1002 such as an advertisement. In other embodiments, a message may a slogan or logo corresponding with a subject of interest to the consumer. Further illustrated is mating portion 1004. In this manner it may be appreciated that any number of accessories may be coupled with bag holding device embodiments disclosed herein. For example, in embodiments, accessories may include, novelty items, promotional items, and message boards of plaques without limitation. Although some of these accessories are not illustrated here, one skilled in the art will readily recognize the utility and configuration of such examples based on the illustrative representation provided.

The terms "certain embodiments", "an embodiment", "embodiment", "embodiments", the embodiment", the embodiments", one or more embodiments", some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A bag holding device comprising:

a base having an inclined housing portion and a raised planar portion;

a spring-loaded clamping element disposed along the raised planar portion and pivotally coupled with the planar portion; and a retractable reel disposed within the inclined housing portion.

2. The device of claim 1, further comprising:

a mating groove disposed along an outer edge of the inclined housing portion; and a bowl having a mating portion that mates with the mating groove.

3. The device of claim 1, further comprising:

a mating groove disposed along an outer edge of the inclined housing portion; and an accessory having a mating portion that mates with the mating groove, wherein in the accessory is selected from the group consisting of: a novelty item, a promotional item, and a message plaque.

4. The device of claim 1, wherein the spring-loaded clamping element comprises:

a plurality of notched teeth disposed along a proximal edge of the spring-loaded clamping element, wherein the plurality of notched teeth are located to exert clamping force along a boundary line between the inclined housing portion and the raised planar portion;

a torsion spring disposed along a pivot axis for providing a clamping force; and a catch disposed along a distal edge of the spring-loaded clamping element for releasably securing a retractable line.

5. The device of claim 4, wherein the catch is a structure selected from the group consisting of: a hook, a ring, a slot, and a tab.

6. The device of claim 4, wherein the torsion spring has a torque in a range of approximately 4.25 to 5.50 inch-pounds at 90 degrees.

7. The device of claim 4, wherein each of the plurality of notched teeth have a width in a range of approximately 0.10 to 0.20 inches.

8. The device of claim 4, further comprising:

an indent disposed along a top surface of the spring-loaded clamping element for providing tactile feedback to a user.

9. The device of claim 1, wherein the retractable reel comprises:

a length of retractable line retractably secured with the retractable reel; and a stopper disposed along an end of the length of retractable line.

10. The device of claim 9, wherein the stopper is selected from the group consisting of: a ring, a ball, a rubber stopper, a cork stopper, a loop, and a hook.

11. A bag holding device comprising:

a base having an inclined housing portion and a raised planar portion;

a spring-loaded clamping element disposed along the raised planar portion and pivotally coupled with the planar portion;

a retractable reel disposed within the inclined housing portion;

a mating groove disposed along an outer edge of the inclined housing portion; and a bowl having a mating portion that mates with the mating groove.

12. The device of claim 11, wherein the spring-loaded clamping element comprises:

a plurality of notched teeth disposed along a proximal edge of the spring-loaded clamping element, wherein the plurality of notched teeth are located to exert clamping force along a boundary line between the inclined housing portion and the raised planar portion;

a torsion spring disposed along a pivot axis for providing a clamping force; and a catch disposed along a distal edge of the spring-loaded clamping element for releasably securing a retractable line.

13. The device of claim 12, further comprising:

an indent disposed along a top surface of the spring-loaded clamping element for providing tactile feedback to a user.

14. The device of claim 11, wherein the retractable reel comprises:

a length of retractable line retractably secured with the retractable reel; and a stopper disposed along an end of the length of retractable line.

15. A method for securing a bagged product using a bag holding device comprising:

providing the bagged product;

placing the bagged product upright on the bag holding device, the bag holding device comprising, a base having an inclined housing portion and a raised planar portion, a spring-loaded clamping element disposed along the raised planar portion and pivotally coupled with the planar portion, and a retractable reel disposed within the inclined housing portion, wherein the spring-loaded clamping element includes, a plurality of notched teeth disposed along a proximal edge of the spring-loaded clamping element, wherein the plurality of notched teeth are located to exert clamping force along a boundary line between the inclined housing portion and the raised planar portion, a torsion spring disposed along a pivot axis for providing a clamping force, and a catch disposed along a distal edge of the spring-loaded clamping element for releasably securing a retractable line; and clamping a bottom edge of the bagged product with the spring-loaded clamping element.

16. The method of claim 15, further comprising:

folding a top portion of the bagged product;

extending the retractable line over the bagged product; and securing the retractable line with the catch.

17. The method of claim 15, further comprising:

providing an attachable bowl, wherein the attachable bowl includes a mating portion that mates with a mating groove, and wherein the bag holding device further includes the mating groove disposed along an outer edge of the inclined housing portion; and attaching the attachable bowl with the bag holding device.

18. The method of claim 16, further comprising:

unsecuring the retractable line from the catch;

retracting the retractable line; and unfolding the top portion of the bagged product.

* * * * *